US009203151B2

(12) United States Patent
Jacobs

(10) Patent No.: US 9,203,151 B2
(45) Date of Patent: Dec. 1, 2015

(54) METHOD AND SYSTEM FOR MANIFOLD ANTENNAS FOR MULTIBAND RADIOS

(71) Applicant: ARINC INCORPORATED, Annapolis, MD (US)

(72) Inventor: Michael W. Jacobs, Annapolis, MD (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 518 days.

(21) Appl. No.: 13/745,725

(22) Filed: Jan. 18, 2013

(65) Prior Publication Data

US 2015/0303569 A1 Oct. 22, 2015

Related U.S. Application Data

(60) Provisional application No. 61/588,751, filed on Jan. 20, 2012.

(51) Int. Cl.

| | |
|---|---|
| ***H01Q 1/28*** | (2006.01) |
| ***H01Q 5/30*** | (2015.01) |
| ***H01Q 1/50*** | (2006.01) |
| ***H01Q 21/28*** | (2006.01) |
| ***H01Q 21/00*** | (2006.01) |

(52) U.S. Cl.

CPC . *H01Q 5/30* (2013.01); *H01Q 1/28* (2013.01); *H01Q 1/50* (2013.01); *H01Q 21/00* (2013.01); *H01Q 21/28* (2013.01)

(58) Field of Classification Search

CPC ..... H01Q 1/28; H01Q 1/32; H01Q 1/34; H01Q 21/00; H01Q 21/24; H01Q 21/28

USPC ..... 343/705, 708, 893

See application file for complete search history.

(56) References Cited

U.S. PATENT DOCUMENTS

| | | | | |
|---|---|---|---|---|
| 6,844,855 | B2 * | 1/2005 | Carson | 343/705 |
| 7,310,064 | B2 * | 12/2007 | Cobb et al. | 342/386 |
| 7,606,528 | B2 * | 10/2009 | Mesecher | 455/3.02 |
| 7,920,860 | B2 * | 4/2011 | Chari et al. | 455/431 |

* cited by examiner

*Primary Examiner* — Hoang V Nguyen

(74) *Attorney, Agent, or Firm* — Ronald E. Prass, Jr.; Prass LLP

(57) ABSTRACT

Systems and methods are disclosed to intelligently employ antenna resources in a manner that may reduce interference between communications signals even in instances where multiple separate frequency band communications need to be supported in a vehicle of limited size. A manifold antenna system is proposed that provides a scheme and a physical construct whereby multiple individual radio receiver/transmitter units may share a limited number of transmitting and receiving antennas. The disclosed manifold antenna system is particularly adaptable to aircraft, spacecraft, vessel or vehicle applications where there is limited room for mounting a number of individual antennas as may be needed to support each radio receiver/transmitter unit in an effort to minimize an amount of interference as is conventionally caused by having transmitting antennas located in too close a proximity to receiving antennas.

21 Claims, 5 Drawing Sheets

METHOD AND SYSTEM FOR MANIFOLD ANTENNAS FOR MULTIBAND RADIOS

This application claims priority to U.S. Provisional Patent Application No. 61/588,751, entitled "Method And System For Manifold Antennas For Multiband Radios," filed on Jan. 20, 2012.

BACKGROUND

1. Field of the Disclosed Embodiments

This disclosure relates to methods and systems for enhancing multiband communication, particularly from vehicles, by implementing a scheme to emplace manifold antennas for the plurality of multiband radios installed in the vehicles.

2. Related Art

In conventional aircraft or other transportation platforms, including, but not limited to ships and boats, trains, and service cars and trucks, multiple radios are often installed to allow for broad spectrum communications across various frequency ranges in the radiofrequency (RF) spectrum. These multiple radios may be required to support necessary routine and emergency communications with various fixed and other mobile communications nodes. As an example, for tactical communications, military and other aircraft use a variety of RF bands. These RF bands, which may be primarily used for interactive data communications and/or push to talk voice communications, may include one or more of: the VHF low FM band from 30 to 90 MHz; the VHF AM aviation band from 108 to 138 MHz; the VHF high FM band from 138 to 174 MHz; the UHF AM aviation band from 225 to 400 MHz; and the UHF FM band from 406 to 512 MHz. This list is, however, non-exhaustive as other bands may also be employed to facilitate other wireless voice and data communications.

Single unit radio devices are available that are capable of conducting transmitting and receiving operations over most, or all of these frequency bands. A challenge in operating these frequency-agile single unit radio devices for multiple frequency band communications is the mating of these single unit radio devices to multiple antennas that may optimally or efficiently support the broad frequency ranges and the consequent resulting range of wavelengths. Simple antennas are, for example, available to cover each frequency band, or to optimally cover at least a significant portion of each frequency band. More complicated antennas or antenna arrays, however, are required to support communications over more than one, or all, of the frequency bands. Conventionally, multiband antennas include represent a tradeoff in operational effectiveness in which increased bandwidth may be achieved only at the expense of reduced efficiency.

Additionally, based on the limited opportunity to optimally separate antennas on smaller vehicles, including aircraft, difficulties arise when multiple radios operating in the same frequency band or bands are employed to support broad spectrum communications from the smaller vehicle. In general, for each single multiband radio unit installed on a platform, one multiband antenna is also installed. In the past, the individual antennas supporting the individual radios have been installed, in many instances, at random locations on the external surface of the vehicle, wherever physical space is available and to which a wired connection, often using a coaxial cable between the radio and the antenna can be most easily effected.

Even when some order is introduced into the scheme for antenna placement such that the locations for the antennas on the outside of the vehicle are selected with some care for electrical performance, it is not always possible to maintain sufficient distance between antennas so as to preclude the signals transmitted from one antenna, regardless of attenuation, causing interference with signals transmitted from or received by other antennas.

As more radios and their associated antennas are installed on a vehicular platform, the distance separating individual antennas from one another necessarily decreases. The unavoidable increase in physical proximity between individual antennas leads to reduced signal isolation between transmitting radios and receiving radios and a consequent increase in interference between radio signals.

SUMMARY OF DISCLOSED EMBODIMENTS

As communications requirements from individual mobile platforms and vehicles increase, the above-identified shortfalls in conventional antenna placement will become more pronounced. It would be advantageous to develop a scheme that may apply available technologies in a novel manner to intelligently employ antenna resources in a manner that may reduce interference between communications signals even in instances where multiple separate frequency band communications need to be supported in a vehicle of limited size.

Exemplary embodiments of the systems and methods according to this disclosure may implement a manifold antenna system.

In exemplary embodiments, the disclosed manifold antenna system may provide a scheme and/or a physical construct whereby multiple individual radio receiver/transmitter (R/T) units may share a limited number of transmitting and receiving antennas.

The disclosed schemes for implementing a manifold antenna system may be particularly adaptable aircraft, spacecraft, vessel or vehicle applications where there is limited room for mounting a number of individual antennas as may be needed to support each radio R/T unit in a one-to-on relationship between the individual antenna and the individual radio R/T unit of a conventional installation.

Exemplary embodiments may reduce a total number of antennas required on a particular platform. Reduction in the number of individual antennas, and the increased opportunity to optimally place the manifold antenna system unit(s) on a body of the platform may aid in minimizing an amount of interference as is conventionally caused by having transmitting antennas located in too close a proximity to receiving antennas.

Exemplary embodiment may address known shortfalls in prior art systems in which, for a given platform, there are understood to be only a limited number of cases where a maximum possible isolation between individual antenna installations may be obtained.

These and other features, and advantages, of the disclosed systems and methods are described in, or apparent from, the following detailed description of exemplary embodiments.

BRIEF DESCRIPTION OF THE DRAWINGS

Various exemplary embodiments of the disclosed methods and systems for enhancing multiband communication, particularly from vehicles, by implementing a scheme to emplace manifold antennas for the plurality of multiband radios installed in the vehicles according to this disclosure will be described, in detail, with reference to the following drawings, in which.

DESCRIPTION OF THE DISCLOSED EMBODIMENTS

Figure 1:
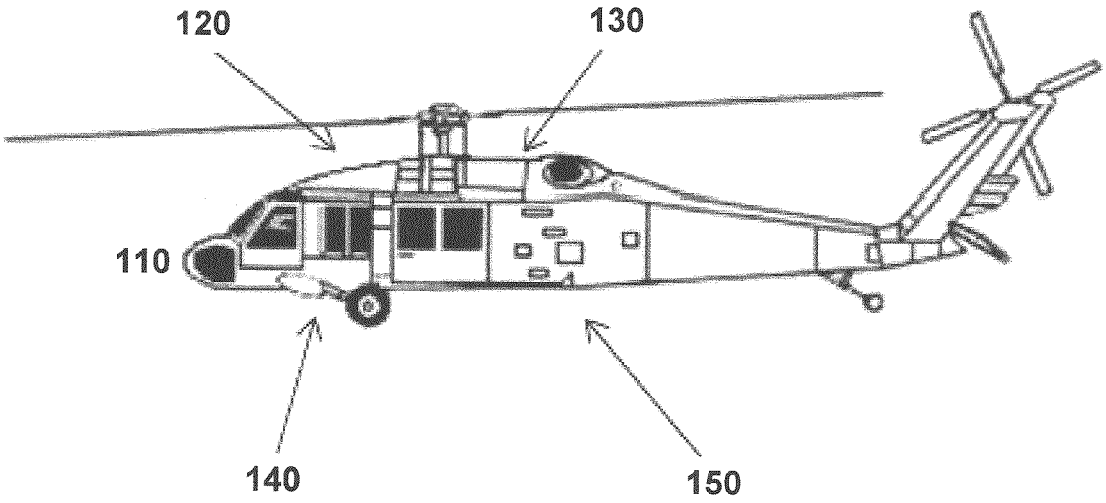
FIG. 1 illustrates a simple schematic representation of a typical antenna installation on an aircraft that will benefit from implementation of the disclosed manifold antenna scheme.

The disclosed systems and methods for enhancing multiband communication, particularly from vehicles, by implementing a scheme to emplace manifold antennas for the plurality of multiband radios installed in the vehicles according to this disclosure may discuss such a particular implementation for the disclosed systems and methods. References to either or both of a particular physical structure or a particular operational implementation may be made throughout this disclosure for clarity, conciseness and understanding of a single implementation for the disclosed embodiments. These references should be considered, however, as exemplary only and not limiting, in any way to the disclosed systems and methods. In particular, the principles incumbent in the disclosed schemes for implementing a multiband communications via a particular manifold antenna system may be subject to wide variation in both physical construct and operational implementation.

Specific reference to, for example, any particular vehicle is should also be understood as being exemplary only, and not limited, in any manner, to any particular class of vehicles for travel on ground, by rail, in the air, on the sea, or under the sea. The systems and methods according to this disclosure may have been developed as be particularly adaptable to being hosted on an aircraft body, but virtually any land, sea, subsea, air or space vehicle, particularly those of limited size, that may benefit from the inclusion of a manifold antenna system such as that disclosed in this application are intended to be included in the term "vehicle" as that term is used throughout.

Individual features and advantages of the disclosed systems and methods will be set forth in the description that follows, and will be, at least in part, obvious from the description, or may be learned by practice of the features described in this disclosure. The features and advantages of the systems and methods according to this disclosure may be realized and obtained by means of the individual elements, and combinations of those elements, as particularly pointed out in the appended claims. While specific implementations are discussed, it should be understood that this is done, as detailed above, for clarity and illustration purposes only. A person skilled in the relevant art will recognize that other components and configurations may be used without departing from the spirit and scope of the subject matter of this disclosure. The features and advantages of the disclosed embodiments may be realized and obtained by means of the instruments and combinations particularly pointed out in the appended claims.

In exemplary embodiments, the disclosed manifold antenna system may provide a scheme and/or a physical construct whereby multiple individual radio R/T units may share a limited number of transmitting and receiving antennas. This scheme may be particularly advantageous when implemented in aircraft, spacecraft, vessels, or vehicles. These applications conventionally attempt to make optimum use of the limited room for mounting the number of antennas needed to provide individual antennas to each radio. An objective of the disclosed schemes is to apply an intelligent process for physically constructing an antenna laydown for a vehicle that may reduce the total number of antennas required on the vehicle. An advantageous outcome of such optimal placing of the antenna system for the vehicle may minimize the amount of interference caused by having transmitting antennas too close to receiving antennas, particularly on a vehicle platform that requires multiple radios to effectively operate, but provides a limited surface area on which to mount multiple antennas generally precluding the optimal placement required to avoid all interference.

As was noted above, a common example that will be relied upon as a baseline for describing the disclosed exemplary embodiments recognizes that, for tactical communications, military and other aircraft use a variety of radio frequency bands. The bands used for interactive communications such as push to talk voice include the VHF low FM band from 30 to 90 MHz, the VHF AM aviation band from 108 to 138 MHz, The VHF high FM band from 138 to 174 MHz, the UHF AM aviation band from 225 to 400 MHz, and the UHF FM band from 406 to 512 MHz. This list is not exhaustive as other bands may also be employed.

Single unit multiband radio devices are available that operate over most or all of these frequency bands. Military aircraft may carry a plurality of such single unit multiband radio devices to facilitate simultaneous communications on multiple ones of the multiple bands supported by these radios. This produces a challenge for antenna selection and placement. First, antennas must be selected that may adequately support transmission and reception across broad frequency ranges with resultant broad variations in supported wavelengths. Simple antennas are available that may cover all or a part of a single band. More complicated antennas are generally required to cover all of the bands. These multiband antennas include provisions that trade bandwidth for efficiency in an inverse relationship.

In general, for each individual radio R/T unit installed on a vehicular platform, one multiband antenna is also installed. Based on physical constraints, these antennas have been installed in many cases at random locations where physical space is available and to which a coaxial cable can be reached. Even when locations are selected with some care for operational performance, it is not always possible to maintain sufficient distance between antennas such that the signals transmitted from one are attenuated enough to avoid causing interference with others. As more radios and additional antennas associated with those radios are installed on the vehicular platform, the distance separating the individual antennas necessarily decreases. This leads to even further reduced isolation between transmitting radios and receiving radios and a consequent additional increase in interference.

FIG. 1 illustrates a simple schematic representation 100 of a typical antenna installation on an aircraft 110 that will benefit from implementation of the disclosed manifold antenna scheme. As will be discussed in further detail below, FIG. 1 is intended to show one example of a potential separation scheme of transmit and receive antennas on an aircraft 110. Alternate antennas may be provided for redundancy in event of the failure of a primary antenna. For a given vehicular platform, such as the small aircraft 110 shown in FIG. 1, there are generally understood to be only a limited number of cases where the maximum possible isolation between antennas is achievable. For the small aircraft 110, the antenna separation scheme generally proposes to emplace one set of antennas on the top of the fuselage to gain maximum physical separation from another set of antennas on the bottom of the fuselage. The separation may be enhanced by providing additional horizontal spacing, with, for example, a primary set of one or more transmit antennas being placed in the area noted by arrow 120 on the top forward portion of the aircraft fuselage. In this example, a secondary set of one or more transmit antennas may be placed in the area noted by arrow 130 on the top aft portion of the aircraft fuselage. A primary set of one or more receive antennas may be placed in the area noted by arrow 150 on the bottom aft portion of the aircraft fuselage. And, a secondary set of one or more receive antennas may be placed in the area noted by arrow 140 on the bottom forward portion of the aircraft fuselage. Computer analysis and physical on-aircraft testing may be performed to evaluate the isolation.

From an optimal isolation standpoint, there can only be two antennas on the aircraft 110. Adding a third antenna begins to adversely affect an optimal isolation scheme. In order to attempt to maintain some semblance of optimal isolation while operating multiple radios on an aircraft 110 that uses only two antennae, combining techniques must be employed. The basic concept is to have one (or one per band) antenna as a combined transmit antenna, and one (or one per band) antenna as a combined receive antenna supporting all of the radio communications that may be transmitted from or received by potentially multiple radio R/T units that may be operated in a particular band at a particular time. As indicated above, there may be an option to include spare antennas, which may be provisioned for redundancy.

Those of skill in the art recognize that a "rule" regarding operational signal interference between antennas is that transmit antennas do not ordinarily interfere with transmit antennas, and receive antennas do not ordinarily interfere with receive antennas. Thus, it is possible to create areas of the aircraft 110, such as those shown by the arrows 120-150 in FIG. 1, dedicated to each function and to separate them in an intelligent manner so as to maximize isolation and yet to reserve placement for alternate antennas in a manner that provides necessary operational redundancy. Within each area 9 dentified by the arrows 120-150, the antenna or antennas can be selected to maximize the system performance or to minimize the number or visibility of the antennas in each area.

Figure 2:
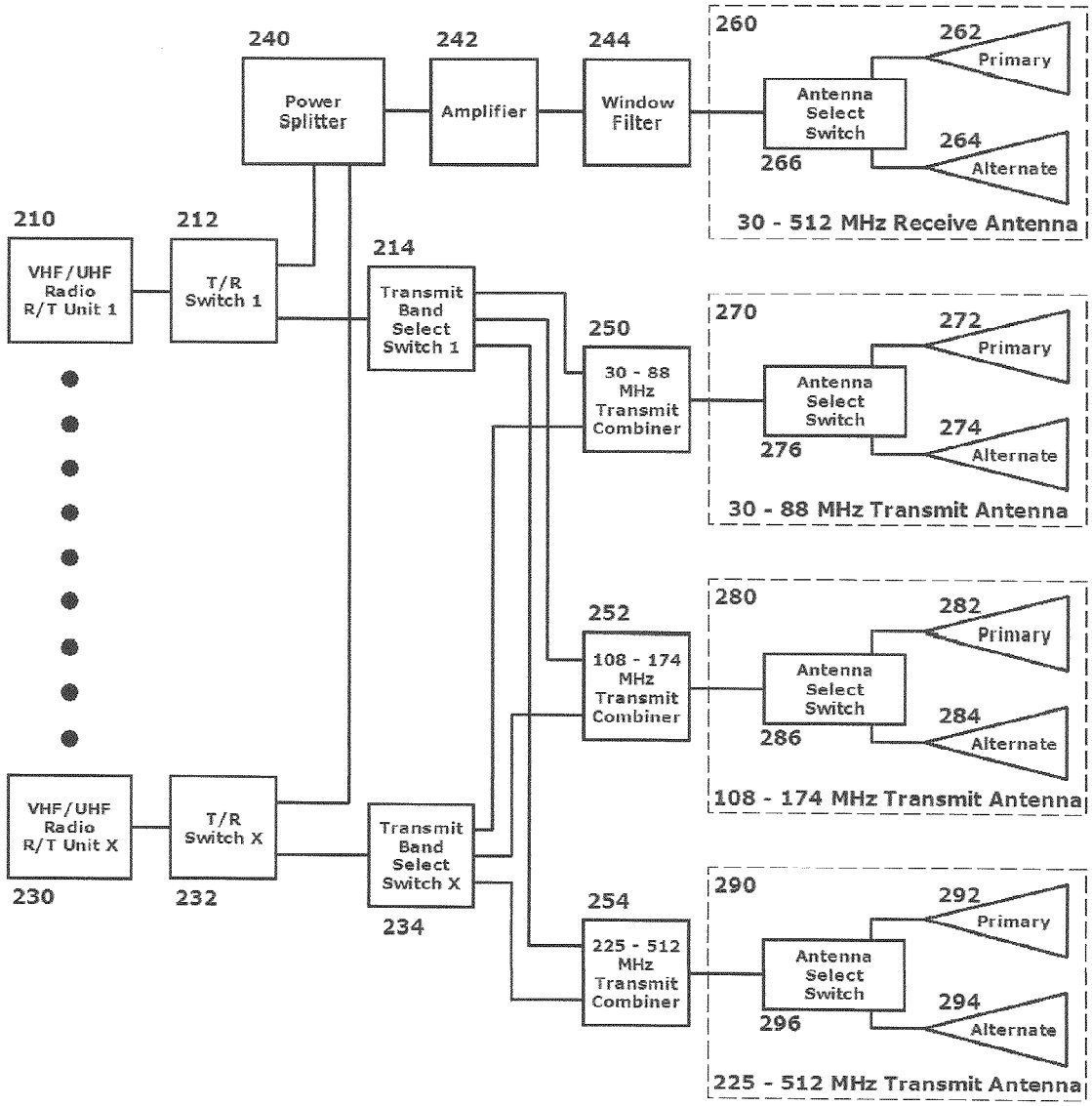
FIG. 2 illustrates a simple schematic representation of components of an exemplary manifold antenna system architecture according to this disclosure.

FIG. 2 illustrates a simple schematic representation of components of an exemplary manifold antenna system architecture according to this disclosure. The exemplary system shown in FIG. 2 may be typical of an example installation to implement the disclosed scheme on major aircraft and mobile communications frequency bands from 30 to 512 MHz. Operation can be expanded to additional bands, as required.

Using hypothetical wideband combining devices, more than one multiband radio R/T unit can be connected to a single transmit antenna and a single receive antenna, each of the single transmit antenna and the single receive antenna being emplaced at most widely separated physical location on an aircraft, such as the exemplary aircraft 110 shown in FIG. 1. This placement may result in the optimal possible isolation and the lowest self-caused interference possible.

Unfortunately, the components used to make combining devices have frequency limitations. It is possible to construct a wideband passive combining device to cover the entire frequency range from 30 to 512 MHz for receive applications. Referring to FIG. 2, such a physical construct may include the following elements. A receive antenna system 260 may be provided that includes a primary receive antenna 262 and an alternate receive antenna 264 with an antenna select switch 266 to effect selection of one or the other of the primary receive antenna 262 and the alternate receive antenna 264. The primary receive antenna 262 and the alternate receive antenna 264 may be optimally placed on a vehicle body and may be separately placed at physical locations displaced from one another. The receive portion of the disclosed system may also include one or more circuits or devices to operate respectively as a power splitter 240, an amplifier 242 and a window filter 244 according to known methods.

As shown, the single receive side unit (or collection of identified components 240-244 and 260-266) acting as a wideband passive combining device may be adequate to cover an entire multiband spectrum for communications, for example, from 30 MHz to 512 MHz. Effecting transmit communications across the multiple bands within this broad frequency range may however, prove much more of a challenge.

In order to provide radio R/T units with complete frequency agility, the combining device must either use tuned components that are adjusted in real time or break the overall frequency range into sub-bands for individual passive combining. The latter approach may be preferred since the use of active tuning adds complexity and reduces main time between failures (MTBF) for a system.

An example construct for the transmit side of the disclosed combiner may include a plurality of frequency band specific transmit units. Each frequency band specific transmit unit may include a band specific transmit combiner 250,252,254, each of which is shown in FIG. 2 as being associated with communications in a particular sub-band portion of the overall operating spectrum for the exemplary system. Each band specific transmit combiner 250,252,254 may be associated with a respective transmit antenna system 270,280,290, as depicted. In turn, much the same as the receive antenna system 260 described above, each of the transmit antenna systems 270,280,290 may include a primary transmit antenna 272,282,292 and an alternate transmit antenna 274,284,294 with an antenna select switch 276,286,296 to effect selection, in each of the frequency band specific transmit units, between one or the other of the primary transmit antennas 272,282,292 and the alternate transmit antennas 274,284,294. Again here, the primary transmit antennas 272,282,292 and the alternate transmit antennas 274,284,294 may be optimally placed on a vehicle body and may be separately placed at physical locations displaced from one another.

As depicted and described the exemplary scheme implements a passive system. Generally, the only active portion of the disclosed combiner may include/involve switching of the RF path for band selection and redundancy.

The disclosed system may include a number of multiband VHF/UHF Radio R/T units 1-X 210,230, which may include as many as eight or more individual multiband VHF/UHF Radio R/T units installed in the vehicle. Multiband VHF/UHF Radio R/T units 1-X 210,230 may be configured to be supported by a single transmit/receive RF connector. In such a configuration, the multiband VHF/UHF Radio R/T units 1-X 210,230 may require an external transmit/receive switch 1-X 212,232 that may be controlled by, for example, each radio unit's push-to-talk (PTT) circuit to select either the receive or transmit portions of the system. Normally, the multiband VHF/UHF Radio R/T units 1-X 210,230 would be in, or default to, a passive receive mode. Activation of an individual radio's PTT circuit may switch the operating mode from the passive receive mode to the active transmit mode with an associated switching from the passive receive side of the system to the active transmit side for operations. In embodiments, if the individual multiband VHF/UHF Radio R/T units 1-X 210,230 have separate transmit and receive connectors then an external transmit/receive switch 1-X 212,232 may not be required.

The receive side of each external transmit/receive switch 1-X 212,232 may be connected to an output from the receive signal power divider 240. The receive signal path may start at one or the other of the primary receive antenna 262 and the alternate receive antenna 264, as selected by the antenna select switch 266. As indicated, the primary receive antenna 262 and the alternate receive antenna 264 may each be a wideband antenna covering the 30-512 MHz multiband frequency range, or other frequency range as required by the specific installation (or a combination of signals from antennas covering individual sub-bands and combined together). The receive signal path may continue through a filter, such as the window filter 244 shown in FIG. 2 in order that the system may be protected from out of band signals. The receive signal path may then pass through an amplifier 242 that compensates for the losses in the power splitter 240. A net result may be that a receive signal presented to the multiband VHF/UHF Radio R/T units 1-X 210,230 is similar in signal strength and signal to noise ratio (SNR) to a signal that may be presented to a corresponding multiband VHF/UHF Radio R/T unit from a dedicated antenna.

For the transmit side, which may be accessed using the PTT circuit for one or more of the multiband VHF/UHF Radio R/T units 1-X 210,230, due to limitations in the availability of passive components, the overall frequency range may be divided into sub-bands that may be combined individually according to a physical or circuit structure with elements such as those shown in FIG. 2, as described above. The output of each band specific transmit combiner 250,252, 254 may be passed to a respective transmit antenna system 270,280,290, as depicted. Alternatively, in embodiments, a multiplexer (not shown) may be employed to combine one or more sub-band combiner outputs into a single antenna.

Single band antennas are more efficient usually than multiband antennas, so if sufficient space may be available in the designated transmit antenna area, it is anticipated that a small number of such antennas may be grouped together.

Based on a need to isolate multiband VHF/UHF Radio R/T units 1-X 210,230 transmitter from the others (when multiple multiband VHF/UHF Radio R/T units 1-X 210,230 are transmitting simultaneously), a device may be used to prevent power from flowing in the reverse direction from the hybrid power combiner. An isolator is such a device. One or more isolators may be used to build the combiner. If the combining is done at low power, the hybrid combiner may provide sufficient isolation. This method of combining may add more loss than combining used tuned components, but provides complete frequency agility.

Figure 3:
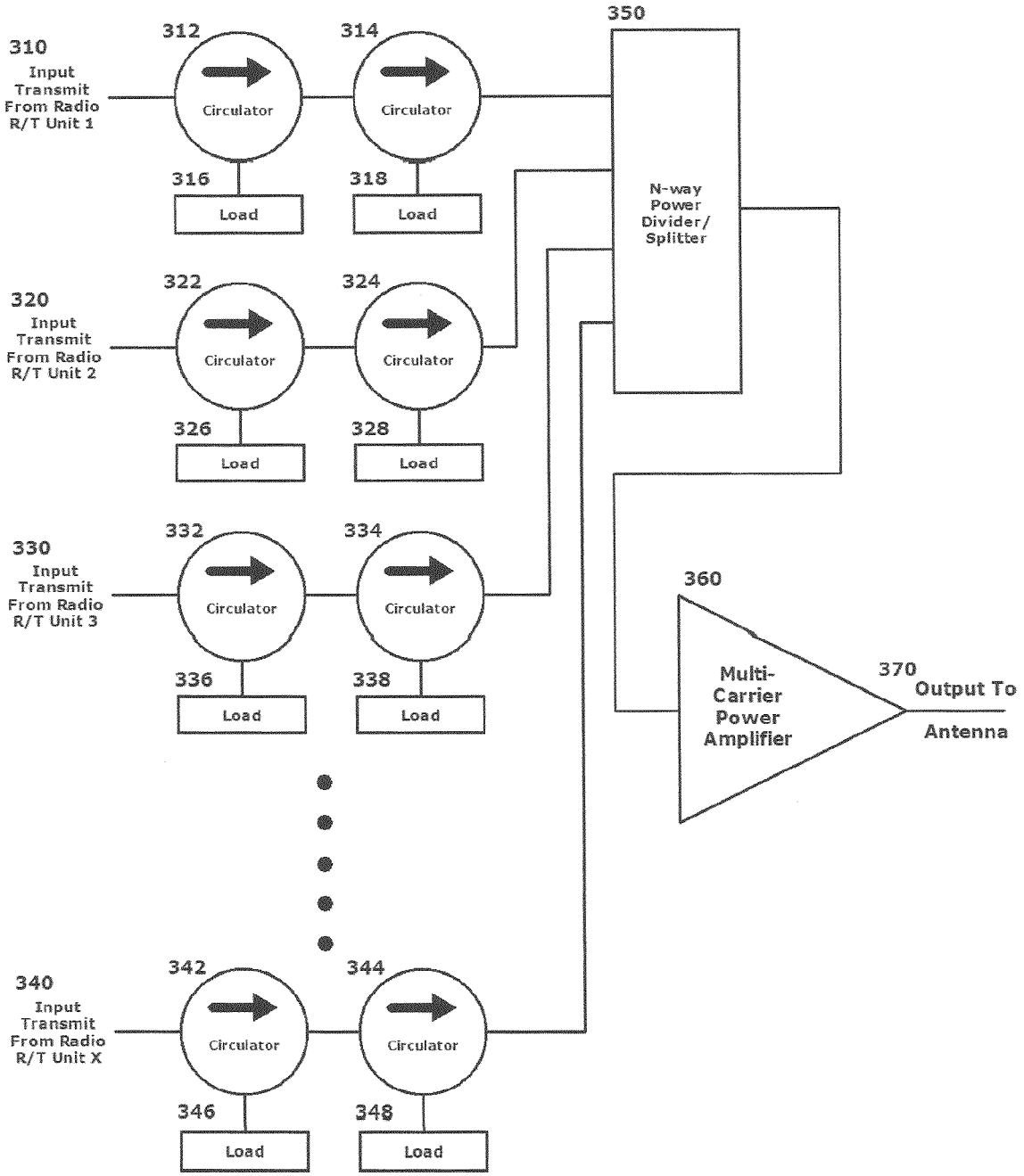
FIG. 3 illustrates a simple schematic representation of a signal flow path from multiple input radio units to an output to an antenna that may be implemented by the manifold antenna system architecture according to this disclosure.

If desired, power amplification using multicarrier amplifiers can be inserted after one or more transmit combiners. FIG. 3 illustrates a simple schematic representation of a signal flow path from multiple input radio units to an output to an antenna that may be implemented by the manifold antenna system architecture according to this disclosure. If it is necessary to compensate for combining loss, one method may be to use a highly linear multichannel power amplifier 360 to provide a boosted signal output to an antenna (at 370 in FIG. 3) to amplify the combined outputs of all of multiband VHF/UHF Radio R/T units 1-X, depicted as inputs 310,320,330,340 in FIG. 3. Since power amplifiers are generally narrow in bandwidth, it is anticipated that one may be used for each band. When sufficiently wideband power combining and amplifying components become available, a single combiner and amplifier may prove sufficient.

In embodiments, input transmits 310,320,330,340 from individual ones of multiband VHF/UHF Radio R/T units 1-X 210,230, as shown in FIG. 2, may be circulated across multiple circulator circuit elements 312,314,322,324,332,334, 342, 344 and loads 316,318,326,328,336,338,346, 348 and to, for example, a four-way power combiner, such as the N-way power divider/splitter 350 shown in FIG. 3 with amplification being performed in multi-carrier amplifier 360 to compensate for combining losses.

The disclosed embodiments may include the shared transmit and receive systems including the combining systems, the redundancy switching, amplification, and the optimization of the locations of the transmit and receive antennas for maximum isolation.

Figure 4:
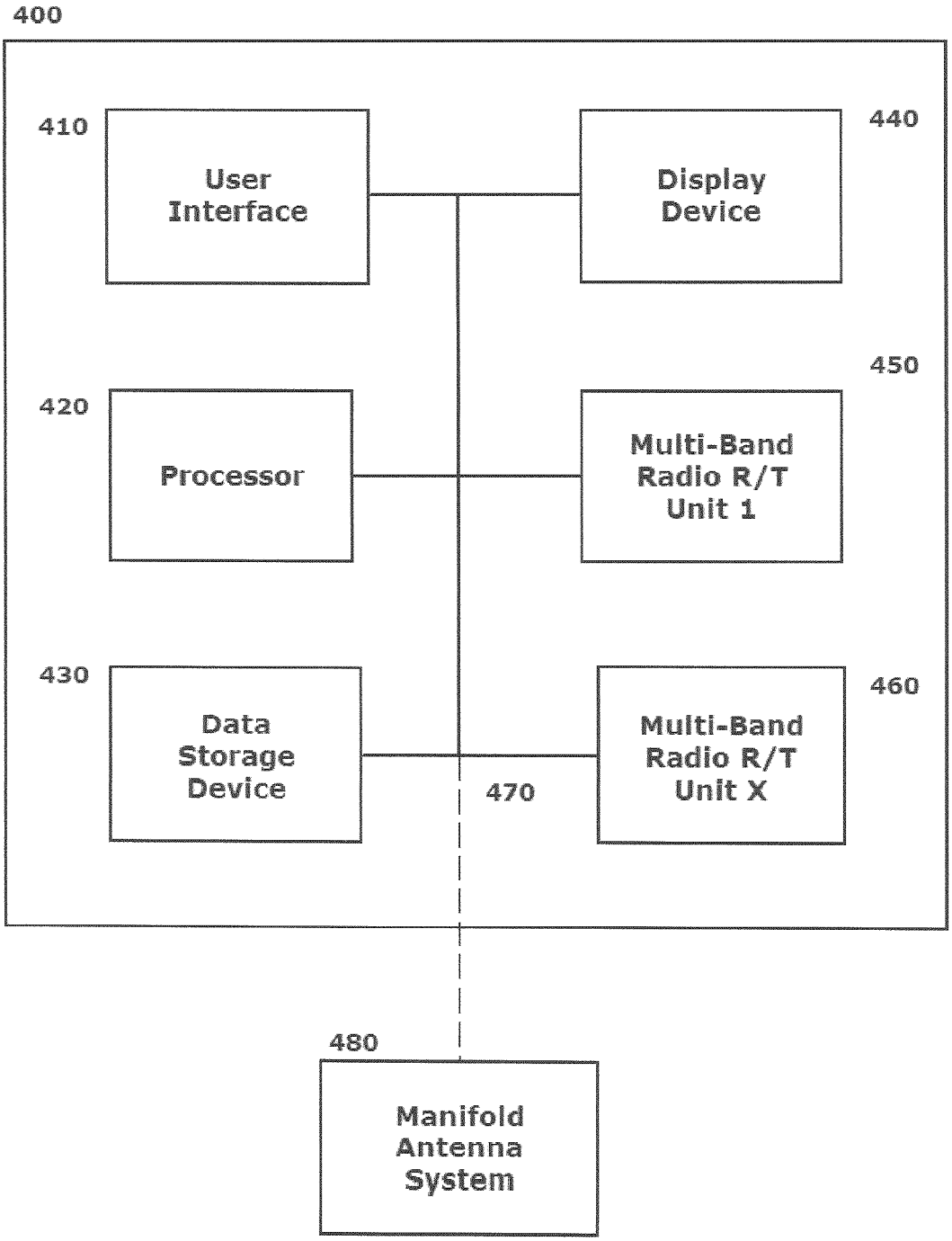
FIG. 4 illustrates a block diagram of an exemplary system for controlling multiband communications, particularly from vehicles, via a manifold antenna system according to this disclosure.

FIG. 4 illustrates a block diagram of an exemplary system 400 for controlling multiband communications, particularly from vehicles, via a manifold antenna system according to this disclosure.

The exemplary system 400 may include a user interface 410 by which the user can communicate with the exemplary system 400, and initiate operations of the exemplary system 400 for implementing multi-radio multiband communications according to the disclosed schemes. As indicated above, user input may be received to switch between a receive mode and a transmit mode in a manifold antenna system by manipulating the PTT circuit for an individual multiband Radio R/T unit such as one or more of a first Multi-Band Radio R/T Unit 1 450 or at least one second Multi-Band Radio R/T Unit X 460. Thus, the PTT button may constitute the user interface 410 to control the exemplary system 400. The user interface 410 may alternatively be configured as one or more conventional mechanisms that permit a user to manipulate the exemplary system 400 as those conventional mechanisms would be understood to one of skill in the art. A user may make inputs via the user interface 410 to simply turn the exemplary system 400 ON, thereby initiating automated operations of the radio/manifold antenna system 480.

The exemplary system 400 may include one or more local processors 420 for individually undertaking the processing and control functions that are carried out by the exemplary system 400. Processor(s) 420 may include at least one conventional processor or microprocessor that interprets and executes instructions and processes for processing coordinating circuit operations for transition between a default passive receive mode and a transmit mode as discussed above. Processor(s) 420 may select which transmission combiner in a multiple transmission combiner system that a particular transmit signal should be directed to.

The exemplary system 400 may include one or more data storage devices 430. Such data storage device(s) 430 may be used to store data, and operating programs or applications to be used by the exemplary system 400, and specifically the processor(s) 420. Data storage device(s) 430 may include a random access memory (RAM) or another type of dynamic storage device that stores information and instructions for execution by the processor(s) 420. Data storage device(s) 430 may also include a read-only memory (ROM), which may include a conventional ROM device or another type of static storage device that stores static information and instructions for execution by the processor(s) 420. The data storage device(s) 430 will generally be those that are integral to the exemplary system 400 and/or to one or more of the Multi-Band Radio R/T Units 450,460.

The exemplary system 400 may include at least one data display device 440, which may be configured as one or more conventional mechanisms that display information to the user of the exemplary system 400 for operation of the exemplary system 400 in its various operating modes, or otherwise for displaying, for example, usable information on a status of the operation of the manifold antenna system 480.

All of the various components of the exemplary system 400, as depicted in FIG. 4, may be connected by one or more data/control busses 470. The data/control bus(ses) 470 may provide internal wired or wireless communication between the various components of the exemplary system 400, as certain of those components are housed integrally as a single unit that is a part of the exemplary system 400, or are housed separately and in wireless communication with the exemplary system 400.

It is anticipated that the various disclosed elements of the exemplary system 400 may be arranged in combinations of sub-systems as individual components or combinations of components. Certain of the depicted components may be integral to a single unit that is exemplary system 400, and include one or more radio device(s). Otherwise, individual components, or combinations of components, may be separately presented and in wired or wireless communication with other of the individual components of the exemplary system 400, or with the one or more radio device(s). In other words, no specific configuration as an integral unit including one or more radio device(s), or as a separate support unit associated with one or more radio device(s), for the exemplary system 400 is to be implied by the depiction in FIG. 6.

Figure 5:
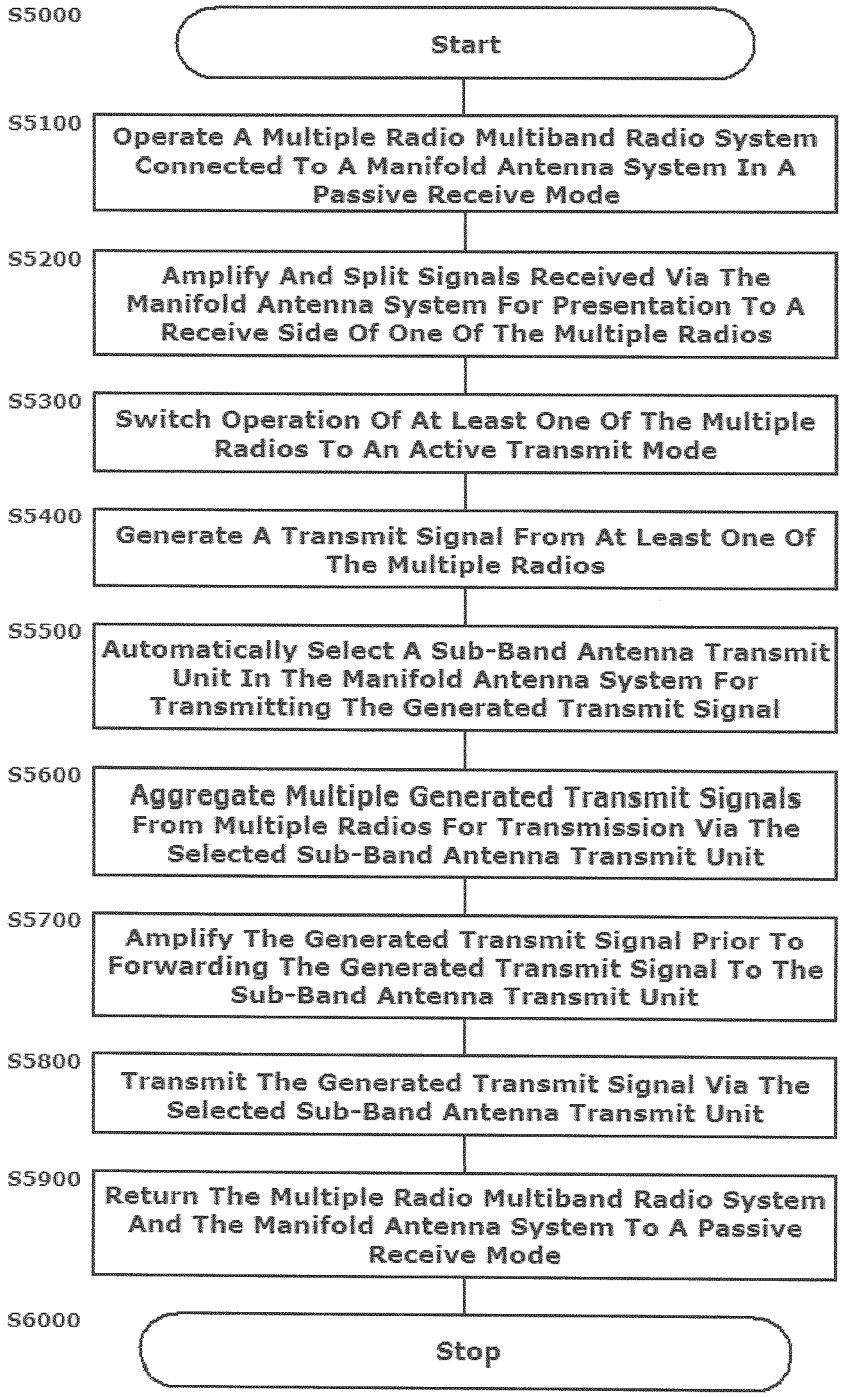
FIG. 5 illustrates a flowchart of an exemplary method for implementing multiband communications, particularly from vehicles, via a manifold antenna system according to this disclosure.

The disclosed embodiments may include an exemplary method for implementing multiband communications, particularly from vehicles, via a manifold antenna system. FIG. 5 illustrates a flowchart of such an exemplary method. As shown in FIG. 5, operation of the method commences at Step S5000 and proceeds to Step S5100.

In Step S5100, a multiple radio multiband radio system installed, for example, in a vehicle such as an aircraft may be connected to a manifold antenna system such as that described in detail above and may be operated in a default passive receive mode in which all signals across multiple bands supported by the radios are received via a single wideband receiving antenna. The single wideband receiving antenna may be located as far from any transmitting antenna as a physical configuration of the body of the vehicle may support, and/or on an opposite side of the body of the vehicle, in an effort to reduce interference between the single wideband receiving antenna and one or more transmitting antennas. Operation of the method proceeds to Step S5200.

In Step S5200, signals received via the single wideband receiving antenna may be split and appropriately amplified for presentation to the receive side of one of the multiple radios on an appropriately-selected frequency. Operation of the method proceeds to Step S5300.

In Step S5300, operation of at least one of the multiple radios may be switched to an active transmit mode. This switching may occur by operator actuation of a press-to-talk circuit for the at least one of the multiple radios. Operation of the method proceeds to Step S5400.

In Step S5400, a transmit signal from the at least one of the multiple radios may be generated to be transmitted on an appropriate frequency to which the at least one of the multiple radios is tuned. Operation the method proceeds to Step S5500.

In Step S5500, in response to recognizing that the at least one of the multiple radios has been switched to an active transmit mode, and that an outgoing transmit signal has been generated, the manifold antenna system may automatically select one of a plurality of a sub-band antenna transmit units in the manifold antenna system for transmitting the generated transmit signal. Each of the plurality of sub-band antenna transmit units in the manifold antenna system may be optimized for communications according to a limited range of frequencies and/or wavelengths that is supported by the each of the plurality of sub-band transmit units. Operation of the method proceeds to Step S5600.

In Step S5600, the manifold antenna system may aggregate multiple generated transmit signals from multiple radios for transmission via the selected one of the plurality of sub-band antenna transmit units. Operation of the method proceeds to Step S5700.

In Step S5700, the generated transmit signal, whether aggregated or not, may be amplified prior to being forwarded to the selected one of the plurality of sub-band antenna transmit units. Operation of the method proceeds to Step S5800.

In Step S5800, the generated transmit signal, pre-processed in the manifold antenna system may be transmitted via the selected one of the plurality of sub-band antenna transmit units. Operation of the method proceeds to Step S5900.

In Step S5900, operation of the multiple radio multiband radio system may be returned to the default passive receive mode in which all signals across multiple bands supported by the radios are received via the single wideband receiving antenna. Operation the method proceeds to Step S6000, where operation of the method ceases.

The disclosed embodiments may include a non-transitory computer-readable medium storing instructions which, when executed by a processor, may cause the processor to execute the steps of a method as outlined above in a manifold antenna system.

The above-described exemplary systems and methods reference certain conventional "known" methods or components to provide a brief, general description of suitable communication and processing environments in which the subject matter of this disclosure may be implemented for familiarity and ease of understanding. Although not required, embodiments of the disclosure may be provided, at least in part, in a form of hardware circuits, firmware or software computer-executable instructions to carry out the specific functions described, including as program modules to be executed by a processor that may execute the disclosed scheme for antenna selection in a manifold antenna system. Generally, program modules are understood to include routine programs, objects, components, data structures, and the like to perform particular tasks or implement particular data types in support of a specific function such as the disclosed implementing function.

Those skilled in the art will appreciate that other embodiments of the disclosed subject matter may be practiced in communication environments according to established communications capabilities for vehicles. The disclosed communication schemes may be executed with many types of communicating devices and/or radios, and should not be considered to be limited to the specific examples discussed above.

As indicated briefly above, embodiments according to this disclosure may include computer-readable media having stored computer-executable instructions or data structures recorded thereon that can be accessed, read and executed by a particular module or device, or system, in, for example, a communicating device as lessor radio in a vehicle. Such computer-readable media can be any available media that can be accessed by a processor in, or in communication with, such a device executing, for example, a manifold antenna control scheme according to this disclosure. By way of example, and not limitation, such computer-readable media can comprise RAM, ROM, EEPROM, CD-ROM, DVD-ROM, flash drives, thumb drives, data memory cards or other analog or digital data storage devices that can be used to carry or store desired program elements or steps in the form of accessible computer-executable instructions and/or data structures. When information is transferred wirelessly via some communications connection a receiving processor properly views the communications connection as a computer-readable medium. Thus, any such connection is properly termed a computer-readable medium. Combinations of the above should also be included within the scope of the computer-readable media for the purposes of this disclosure.

Computer-executable instructions include, for example, non-transitory instructions and data that can be executed and accessed respectively to cause communicating components, including multiband radio R/T units, or processors associated with such radio units, to perform certain of the above-specified functions, individually or in combination. Computer-executable instructions also include program modules that are remotely stored for access by a communicating device or system to be executed by processors in the communicating device or system when the communicating device or system is caused to communicate across any available communication link, particularly those described in exemplary manner above.

The exemplary depicted sequence of executable instructions, or associated data structures for executing those instructions, represents one example of a corresponding sequence of acts for implementing the functions described in the steps. The steps of the method, as depicted in FIG. 5, are not intended to imply that all of the depicted and described steps must be executed as part of a complete method, or that the steps must be executed in any particular order, except as may be necessarily inferred when one of the depicted and described steps is a necessary precedential condition to accomplishing another of the depicted and described steps. The depicted and described steps, where appropriate, may be executed in series or in parallel.

Although the above description may contain specific details, these details should not be construed as limiting the claims in any way. Other configurations of the described embodiments of the disclosed systems and methods are part of the scope of this disclosure. For example, the principles of the disclosure may be applied to each individual communicating device, such as a multiband radio R/T unit, where each individual communicating device may independently operate according to the disclosed system constraints or method steps via a manifold antenna system. Accordingly, the appended claims and their legal equivalents should only define the disclosure, rather than any of the specific examples given.

I claim:

1. An antenna system for a vehicle, comprising:

a receive antenna system including at least one receive antenna, the at least one receive antenna processing incoming communications on frequencies in multiple communicating bands;

a transmit antenna system including:

a plurality of transmit antennas, each of the transmit antennas transmitting outgoing communications on frequencies in an individual communicating band that is one of the multiple communicating bands and that is different from an individual communicating band over which outgoing communications are transmitted on each of the other transmit antennas, and a plurality of transmit combiners respectively associated with the plurality of transmit antennas, each of the plurality of transmit combiners combining outgoing communications on the frequencies in the individual communicating bands on which the respective transmit antenna transmits the outgoing communications.

2. The antenna system of claim 1, further comprising a transmitting antenna selection device that directs the outgoing communications from at least one of a plurality of radios to at least one of the plurality of transmit combiners according to a frequency on which the at least one of the plurality of radios is operating.

3. The antenna system of claim 1, the receive antenna system comprising:

a primary receive antenna;

an alternate receive antenna that is separate and distinct from the primary receive antenna; and an antenna selection device that selects one of the primary receive antenna and the alternate receive antenna to process the incoming communications on frequencies in multiple communicating bands.

4. The antenna system of claim 3, the receive antenna system further comprising a signal splitter that splits the incoming communications according to particular frequencies to separate and route the incoming communications to a receiver in one of a plurality of radios.

5. The antenna system of claim 4, the receive antenna system further comprising an amplifier that amplifies incoming communication signals to account for losses encountered in the signal splitter.

6. The antenna system of claim 5, the receive antenna system further comprising a filter that protects the antenna system from interference based on reception of out of band signals received by the at least one receive antenna.

7. The antenna system of claim 1, each of the transmit antennas transmitting outgoing communications on frequencies in the individual communicating band comprising:

a primary transmit antenna;

an alternate transmit antenna that is separate and distinct from the primary transmit antenna; and an antenna selection device that selects one of the primary transmit antenna and the alternate transmit antenna to process the outgoing communications on frequencies in the individual communicating band with which the each of the transmit antennas is associated.

8. The antenna system of claim 1, wherein the antenna system operates in a passive receive mode as a default mode of operation.

9. The antenna system of claim 8, wherein the antenna system is caused to operate in an active transmit mode upon selection of the active transmit mode by a user.

10. The antenna system of claim 9, wherein the active transmit mode is selected by a user by activating a push-to-talk circuit associated with one or more radios that communicate via the antenna system.

11. The method of claim 1, each of the transmit antennas transmitting outgoing communications on frequencies in the individual communicating band comprising:

a primary transmit antenna;

an alternate transmit antenna that is separate and distinct from the primary transmit antenna; and an antenna selection device that selects one of the primary transmit antenna and the alternate transmit antenna to process the outgoing communications on frequencies in the individual communicating band with which the each of the transmit antennas is associated.

12. A communicating system, comprising:

a plurality of multiband radio receiver/transmitters; and a single manifold antenna system that cooperates with the plurality of multiband radio receiver/transmitters to process outgoing and incoming communications for the plurality of multiband radio receiver/transmitters, the single manifold antenna system comprising:

a receive antenna unit including at least one receive antenna, the at least one receive antenna processing incoming communications on frequencies in multiple communicating bands supported by the plurality of multiband radio receiver/transmitters;

a transmit antenna unit including:

a plurality of transmit antennas, each of the transmit antennas transmitting outgoing communications on frequencies in an individual communicating band that is one of the multiple communicating bands supported by the plurality of multiband radio receiver/transmitters and that is different from an individual communicating band over which outgoing communications are transmitted on each of the other transmit antennas, and a plurality of transmit combiners respectively associated with the plurality of transmit antennas, each of the plurality of transmit combiners combining outgoing communications on the frequencies in the individual communicating bands.

13. The communicating system of claim 12, further comprising a transmitting antenna selection device that directs the outgoing communications from the plurality of multiband radio receiver/transmitters to at least one of the plurality of transmit combiners according to frequencies on which the plurality of multiband radio receiver/transmitters are operating when the manifold antenna system is switched from a default passive receive operating mode to an active transmit operating mode.

14. The communicating system of claim 12, the receive antenna system comprising:

a primary receive antenna;

an alternate receive antenna that is separate and distinct from the primary receive antenna; and an antenna selection device that selects one of the primary receive antenna and the alternate receive antenna to process the incoming communications on frequencies in multiple communicating bands.

15. The communicating system of claim 14, the receive antenna system further comprising at least one of (1) a signal splitter that splits the incoming communications according to particular frequencies to separate and route the incoming communications to a receiver in one of the plurality of multiband radio receiver/transmitters, (2) an amplifier that amplifies incoming communication signals to account for losses associated with the signal splitter, and (3) a filter that protects the antenna system from interference based on reception of out of band signals received by the at least one receive antenna.

16. The communicating system of claim 12, each of the transmit antennas transmitting outgoing communications on frequencies in the individual communicating band comprising:

a primary transmit antenna;

an alternate transmit antenna that is separate and distinct from the primary transmit antenna; and an antenna selection device that selects one of the primary transmit antenna and the alternate transmit antenna to process the outgoing communications from the plurality of multiband radio receiver/transmitters on frequencies in the individual communicating band with which the each of the transmit antennas is associated.

17. The communicating system of claim 12, wherein the plurality of transmit combiners associated with the plurality of transmit antennas combine outgoing communications on the frequencies in the individual communicating bands from more than one of the plurality of multiband radio receiver/transmitters.

18. The communicating system of claim 12, further comprising a transmit band select switch associated with each of the plurality of multiband radio receiver/transmitters to direct outgoing communications from the each of the plurality of multiband radio receiver/transmitters to a selected one of the plurality of transmit combiners based on the frequencies in the individual bands supported by the selected one of the plurality of transmit combiners.

19. A method for communicating from a vehicle, comprising:

operating a manifold antenna system in a default passive receive mode in which a receive antenna processes incoming communications on frequencies in multiple communicating bands supported by a plurality of radios to which the manifold antenna system is connected;

activating a transmit mode to transmit outgoing communications from at least one of the plurality of radios on frequencies in one of a plurality of individual communicating bands that is one of the multiple communicating bands, each of the plurality of individual communicating bands supporting a range of frequencies and being individually supported by a transmit antenna that are separate from the ranges of frequencies and transmit antennas for others of the plurality of individual communicating bands;

selecting the one of the individual communicating bands among the multiple communicating bands, over which to transmit the outgoing communications based on a selected frequency of at least one of the plurality of individual communicating bands being individually supported by a transmit antenna that operates in an individual communicating band over which outgoing communications are transmitted; and transmitting the outgoing communications via a transmit signal combiner and a transmit and antenna for the selected one of the communicating bands.

20. The method of claim 19, the one of the individual communicating bands being selected by a transmitting antenna selection device that directs the outgoing communications from a plurality of radios to at least one of the plurality of transmit combiners according to frequencies on which the plurality of radios are operating.

21. The method of claim 19, the receive antenna system comprising:

a primary receive antenna;

an alternate receive antenna that is separate and distinct from the primary receive antenna; and an antenna selection device that selects one of the primary receive antenna and the alternate receive antenna to process the incoming communications on frequencies in multiple communicating bands.

* * * * *